US005636837A

United States Patent [19]

Takemoto et al.

[11] Patent Number: 5,636,837

[45] Date of Patent: Jun. 10, 1997

[54] PACHINKO GAMING MACHINE

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 367,188

[22] PCT Filed: Jul. 12, 1993

[86] PCT No.: PCT/JP93/00979

§ 371 Date: Apr. 21, 1995

§ 102(e) Date: Apr. 21, 1995

[87] PCT Pub. No.: WO94/01187

PCT Pub. Date: Jan. 20, 1994

[30] Foreign Application Priority Data

Jul. 14, 1992 [JP] Japan ..... 4-187100
Jul. 14, 1992 [JP] Japan ..... 4-187101

[51] Int. Cl.[6] ..... A63F 7/02

[52] U.S. Cl. ..... 723/121 B

[58] Field of Search ..... 273/118–121

[56] References Cited

FOREIGN PATENT DOCUMENTS

| | | | |
|---|---|---|---|
| 63-65349 | 12/1988 | Japan . | |
| 1-141684 | 6/1989 | Japan . | |
| 1-207089 | 8/1989 | Japan . | |
| 1-227780 | 9/1989 | Japan . | |
| 6-31045 | 2/1994 | Japan | 273/121 B |
| 6-23131 | 2/1994 | Japan | 273/121 B |
| 6-31043 | 2/1994 | Japan | 273/121 B |
| 6-31044 | 2/1994 | Japan | 273/121 B |
| 6-71027 | 3/1994 | Japan | 273/121 B |
| 6-63235 | 3/1994 | Japan | 273/121 B |
| 6-277348 | 10/1994 | Japan | 273/121 B |
| WO94/07787 | 1/1994 | WIPO | 273/121 B |

*Primary Examiner*—Raleigh W. Chiu

*Attorney, Agent, or Firm*—Armstrong, Westerman, Hattori, McLeland & Naughton

[57] ABSTRACT

A pachinko game machine wherein a ball payout efficiency is high and a game is not interrupted during play, so that game can be continued without spoiling player's interest. Pachinko balls are directly dispensed to a ball counter from a supply conduit through communicating members, the balls dispensed by the ball counter firstly pass through a supply path for a front tray of an overflow path member and are introduced into the front tray, when the front tray is filled up with the balls pass through a supply path for an under tray and are introduced into the under tray, further, when the under tray is filled up with the balls, the overflowed balls pass through a supply path for counting, are introduced into a held balls counter and counted, and the number of balls is displayed on a held balls display. When the under tray is filled up with the balls, this state is sensed by a sensor, whereby the payout by the ball counter is stopped by way of a controller, and the number of the remaining balls is displayed on the held balls display.

6 Claims, 7 Drawing Sheets

PACHINKO GAMING MACHINE

TECHNICAL FIELD

This invention relates to a pachinko game machine which has a ball counting means for dispensing a given number of pachinko balls, based on the signal from a control means for controlling the pachinko game machine, and pachinko balls are supplied from a supply conduit to the control means through communicating members located in a game machine island.

BACKGROUND ART

There is a prior pachinko ball machine having an upper tray in an upper section of the machine and pachinko balls are supplied to the upper tray, from a supply conduit in a game island through a chute member. In such pachinko game machine, pachinko balls are stored in the upper tray and sent to a lower positioned ball through a counting means for counting and dispensing such balls as needed.

A front tray, located under game panel of the pachinko game machine, for storing dispensed pachinko balls and an under tray for storing overflowed balls are communicated with a bypass. If the under tray has been filled with pachinko balls, a control means stops playing of the game to prevent pachinko balls from overflowing.

In such pachinko game machine, pachinko balls from the supply conduit are brought into a line in the chute means before they are dispensed and stored in the upper tray disorderly, and then they are brought into a line again before being sent to the counting means. Therefore, it takes some time to dispense pachinko balls, and problems such as jamming and dispensing a lot of pachinko balls is inefficient. Furthermore, since a game is always interrupted when the under tray has been filled up with pachinko balls, the interest of a player is spoiled.

DISCLOSURE OF THE INVENTION

The present invention is intended to solve the above-mentioned problems and to provide a pachinko game machine wherein ball dispensing efficiency is high and the game is not interrupted half way during a play, and the game can be continued without spoiling the interest of a player.

According to the present invention, there is provided, in a pachinko game machine (10) having a ball counting means (30) for dispensing a given number of pachinko balls, based on the signal from a control means (40) for controlling the pachinko game machine, and being supplied pachinko balls from a supply conduit (20) to the control means through communicating members (21, 22) located in a game machine island, the pachinko game machine comprising: a front tray (14) for storing pachinko balls dispensed to a player by ball counting means (30); an under tray (15) for storing overflowed balls from front tray (14); a held ball counting means (90), mounted under said under tray (15), for counting pachinko balls overflowed from the under tray (15) at any time; an overflow path member (60) for introducing pachinko balls dispensed from ball counting means (30) to front tray (14), under tray (15) and held ball counting means (90) in the back side of the game panel. Overflow path member (60) is composed of: supply path (61) for front tray for connecting ball counting means (30) and front tray (14), supply path (62) for under tray, branched from supply path (61) for front tray and connected to under tray (15), that introduces pachinko balls overflowed from supply path (61) for front tray to under tray (15) when front tray (14) is filled up with pachinko balls, and supply path (62) for held ball counting means, branched from supply path (62) for under tray and connected to held ball counting means (90), that introduces pachinko balls overflowed from supply path (62) for under tray to held ball counting means (90) when under tray (15) is filled up with pachinko balls; and held ball display (50), FIG. 5, mounted on the front side of game panel (11), FIG. 7, for displaying visibly the number of the pachinko balls according to the orders from the control means (40), FIG. 1, which receives signals from held ball counting means (90) when counting means (90) counts the pachinko balls introduced from the supply path for held ball counting means (64).

Further, according to the present invention, there is provided, in a pachinko game machine (10) having a ball counting means (30) for dispensing a given number of pachinko balls based on the signal from a control means (40) for controlling the pachinko game machine and being supplied pachinko balls from a supply conduit (20) to the control means through communicating members (21, 22) located in a game machine island, the pachinko game machine (10) comprising: a front tray (14) for storing pachinko balls dispensed to a player by said ball counting means (30); an under tray (15) for storing overflowed balls from front tray (14); an overflow path member (160) for introducing pachinko balls dispensed from ball counting means (30) to front tray (14) and the under tray (15) in the back side of the game panel (11), overflow path member (160), FIG. 3, is composed of: a supply path (161) for front tray for connecting ball counting means (30) and said front tray (14) and a supply path (162) for under tray, branched from supply path (161) for front tray and connected to under tray (15), that introduces pachinko balls overflowed from supply path (161) for front tray to the under tray (15) when the front tray (14) is filled up with pachinko balls; a sensing means (169), mounted to supply path (162) for under tray (15), which detects the state of supply path (162) for under tray (15) being jammed with overflowed balls from under tray (15) and outputs a jam signal to said control means (40) for stopping dispensation of pachinko balls by the ball counting means (30); and a held ball display (50), FIG. 5, mounted on the front side of the game panel (11), FIG. 7, which displays visibly the number of remaining pachinko balls to be dispensed when pachinko balls overflow from under tray (15) and ball counting means (30), FIG. 1, interrupts the dispensation of pachinko balls.

Therefore, pachinko balls, flowing in the supply conduit (20), located in the game machine island, are sent to the pachinko game machine (10) through the communicating members (21, 22) and supplied to the ball counting means (30) mounted in the pachinko game machine. Since pachinko balls in the supply conduit (20) are directly supplied to the ball counting means (30), mounted in the pachinko game machine, through the communicating members (21, 22), a storage means positioned in the upper section of the pachinko game machine, such as an upper tray, and so on, for storing pachinko balls temporarily is needless.

From the pachinko balls, supplied to the ball counting means (30), a given number of pachinko balls are dispensed through the overflow path member (60), based on the signal from a control means (40), for controlling the pachinko game machine. The overflow path member (60) is formed integrally in the back side of the game panel (11).

Firstly, pachinko balls are released from the ball counting means (30) to the front tray (14), through the supply path (61) for front tray of the overflow path member (60). When the front tray (14) has been filled up with the pachinko balls, the balls pass through the supply path (62) for under tray branched from supply path (61) for front tray (14) and are introduced into the under tray (15).

When the under tray (15) is also filled up with the pachinko balls, the overflowed balls pass through the supply path for held ball counting means (90) branched from said supply path (62) for under tray (15) and are introduced into the held ball counting means (90) mounted under tray (15). The overflowed balls, introduced into the held ball counting means (90), are counted therein and discharged into a conduit for collecting.

After counting the balls, the held ball counting means (90) outputs a signal which indicates the counted number to the control means (40). Then the counted number of the pachinko balls are displayed visibly by the held ball display (50), FIG. 7, according to the orders from the control means (40) which received signals from the held ball counting means (90).

Since the pachinko balls overflowed from the under tray (15) are counted by the held ball counting means (90) and the counted number of the pachinko balls are displayed visibly by the held ball display (50), there is no need for the game machine in the game being played to be interrupted to prevent the pachinko balls from overflowing from the under tray (15).

In the pachinko game machine (10) having a recording medium issuing means (80), after the game is over, the number of the pachinko balls displayed on the held ball display (50) is recorded in a recording medium, such as, a card, by the recording medium issuing means (80) and then the recording medium is dispensed at (81) to a player. Therefore, it is unnecessary for a player to carry pachinko balls.

In the pachinko game machine (10), having a ball dropping switch (17), FIG. 7, when under tray (15) or both under tray (15) and front tray (14) have capacity for storing more pachinko balls, pachinko balls, corresponding to the number displayed by held ball display (50), can be dispensed to under tray (15) or both under tray (15) and front tray (14) by operating ball dropping switch (17).

In the second embodiment of the invention, as in the first embodiment, a given number of pachinko balls are dispensed from the pachinko balls supplied to the ball counting means (30) through the overflow path member (160) based on the signal from a control means (40) for controlling the pachinko game machine. The overflow path member (160) is formed integrally and detachably in the back side of the game panel (11).

Firstly, pachinko balls are released from the ball counting means (30) to the front tray (14) through the supply path (161) for from tray of the overflow path member (160). When the front tray (14) has been filled up with the pachinko balls, the balls pass through the supply path (162) for under tray branched from said supply path (161) for front tray and am introduced into the under tray (15).

When the under tray (15) is also filled up with the pachinko balls, balls jammed in the supply path (162) for under tray (15) are sensed by a sensing means (70), FIG. 7. At this time, the sensing means (70) outputs a signal which indicates the overflowing state of the under tray (15) to the control means (40) and make the ball counting means (30), FIG. 4, stop dispensing balls via the control means (40).

When pachinko balls overflow from under tray (15) and ball counting means (30) stop dispensing pachinko balls, the number of remaining pachinko balls to be dispensed is displayed visibly by the held ball display (50). Therefore, there is no need for the game machine to interrupt a game, in play for preventing pachinko balls from overflowing from the under tray (15). If trays are filled up with pachinko balls, so-called prize balls are not sent to the tray, such as the front tray (14), and the number of prize balls are added to the number displayed in the held ball display (50); therefore, the game can continue. In the case that the pachinko game machine (10) does not have a recording medium issuing means (80), if an ending switch (18), FIG. 7, is operated, pachinko balls of the number displayed in the held ball display (50) are dispensed into the front tray (14) or under tray (15) by the ball counting means (30) until the displayed number decreased to zero. A player can replace the pachinko balls dispensed into the front tray (14) or the under tray (15) with articles.

In the case that the pachinko game machine (10) has recording medium issuing means (80), when a player operates the ending switch to finish the game, shutters on the front tray (14) and the under tray (15) open to flow pachinko balls remaining in the front tray (14) and the under tray (15) into the held ball counting means (90); then the player's all held balls are displayed in the held ball display (50), and the number of the pachinko balls is recorded in a recording medium, such as, a card, by the recording medium issuing means (80) according to the order of the control means (40) and then the recording medium is dispensed to a player. Therefore it is unnecessary for a player to carry pachinko balls.

In the pachinko game machine (10), FIG. 7, having a ball dropping switch (17), like the first embodiment, when under tray (15) or both under tray (15) and from tray (14) have capacity for storing more pachinko balls, pachinko balls, corresponding to the number displayed by the held ball display (50), can be dispensed to the under tray (15) or both under tray (15) and front tray (14) by operating the ball dropping switch (17).

BEST MODES FOR CARRYING OUT THE INVENTION

Figure 1:
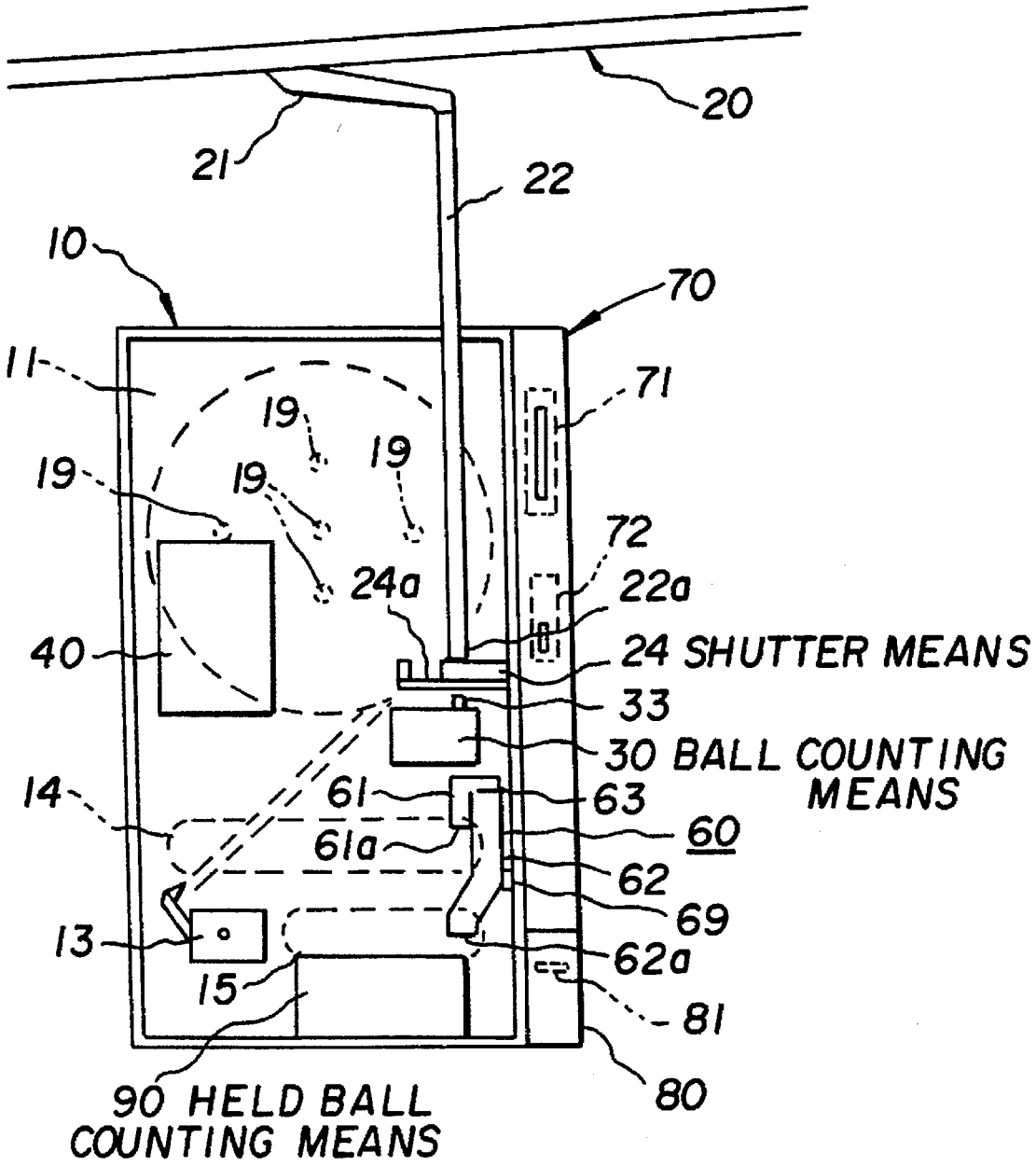
FIG. 1 is a schematic rear elevation of the first embodiment of the pachinko game machine of the present invention.
Figure 2:
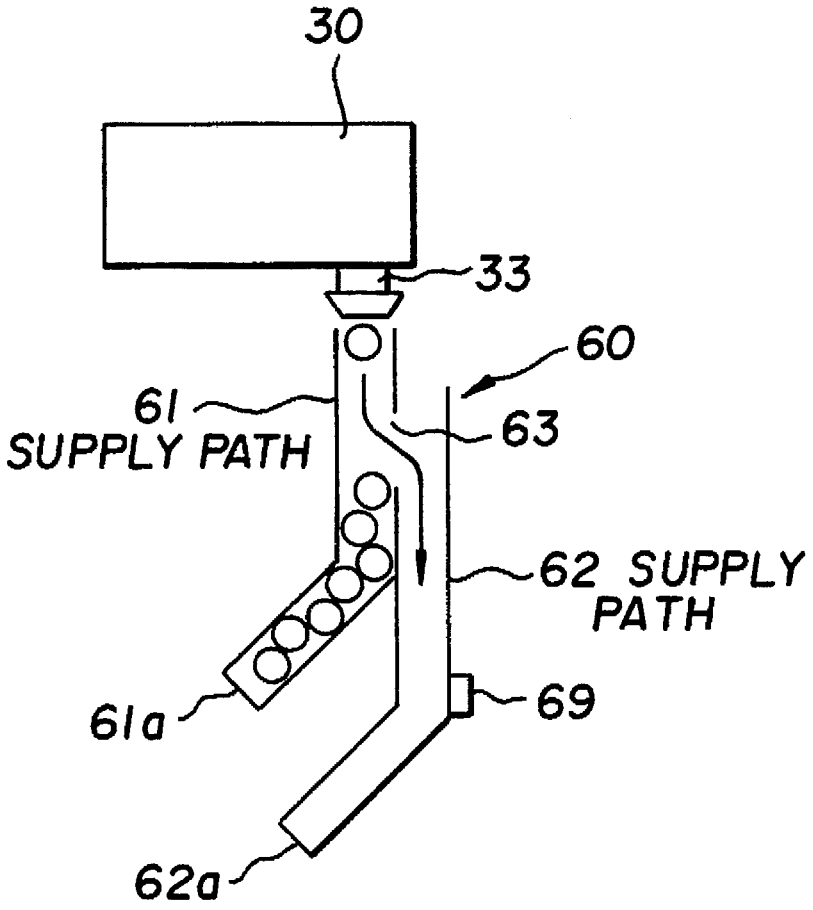
FIG. 2 is a front elevation of the overflow path member of the first embodiment of the present invention.
Figure 7:
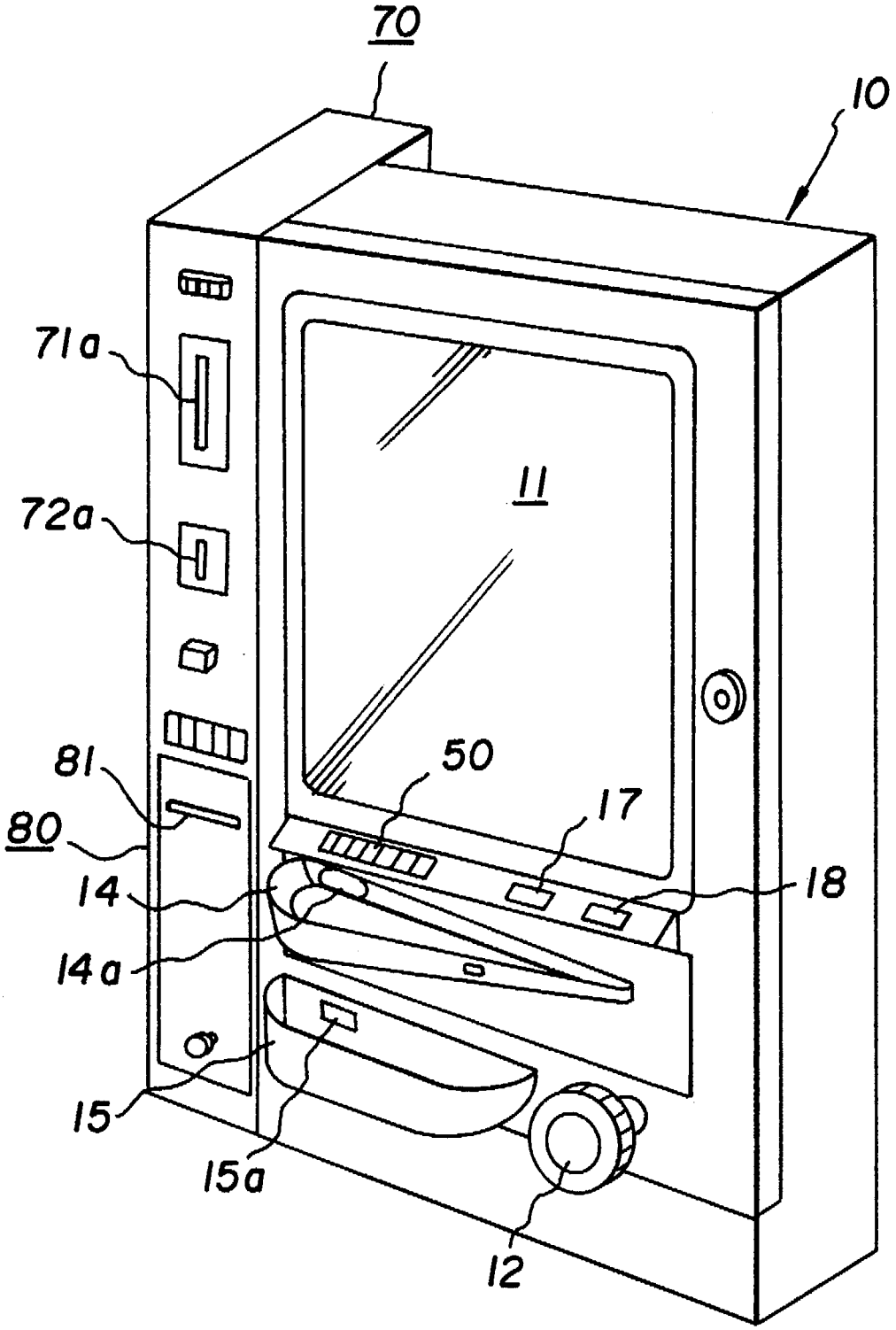
FIG. 7 is a perspective view of the pachinko game machine of the embodiment of the present invention.

The first embodiment of the present invention is shown in FIGS. 1, 2 and 7.

As shown in FIGS. 1 and 7, a pachinko game machine 10 is integrally formed with a ball renting machine 70 for dispensing pachinko balls corresponding to the amount of money inserted thereinto. This pachinko game machine dispenses prize balls to a player according to a prescribed rate when a ball, thrown into a game panel 11 by a ball shooting machine 13 which can be controlled by a handle 12, falls into prize portion 19, 19.

A front tray 14 which stores pachinko balls dispensed to a player and an under tray 15 which stores pachinko balls overflowed from the front tray 14 are mounted below the game panel 11 of the pachinko game machine 10. A held ball counting means 90 which counts pachinko balls overflowing from the under tray 15 and sends a signal indicating the counted number to a control means 40 is positioned below the under tray 15. This held ball counting means 90 is a common ball counter for pachinko game machine, so it will not be explained in detail.

A ball counting means 30 is mounted above the front tray 14, inside the pachinko game machine 10. The ball counting means 30 is a ball counter which dispenses a given number of pachinko balls into the front tray 14 based on the signal from a control means 40.

A lot of such pachinko game machines are arranged on a game machine island, and a supply conduit 20, for supplying pachinko balls to those pachinko game machines, is located above them. The supply conduit 20 are communicated with each game machine 10 by a chute member (communicating member) 21. An outlet of the lower end of the chute 21 is connected to bellows (communicating member) 22 which can stretch and contract. An outlet 22*a* at the lower end of the bellows 22, is directed downward.

The inlet of a ball guide means 33 of the ball counting means 30 is positioned to face the outlet 22*a* of the lower end of the bellows 22. A shutter means 24, for stopping pachinko balls flowing, is mounted between the outlet 22*a* of the lower end of the bellows 22 and the inlet of a ball guide means 33 of the ball counting means 30.

Figure 6:
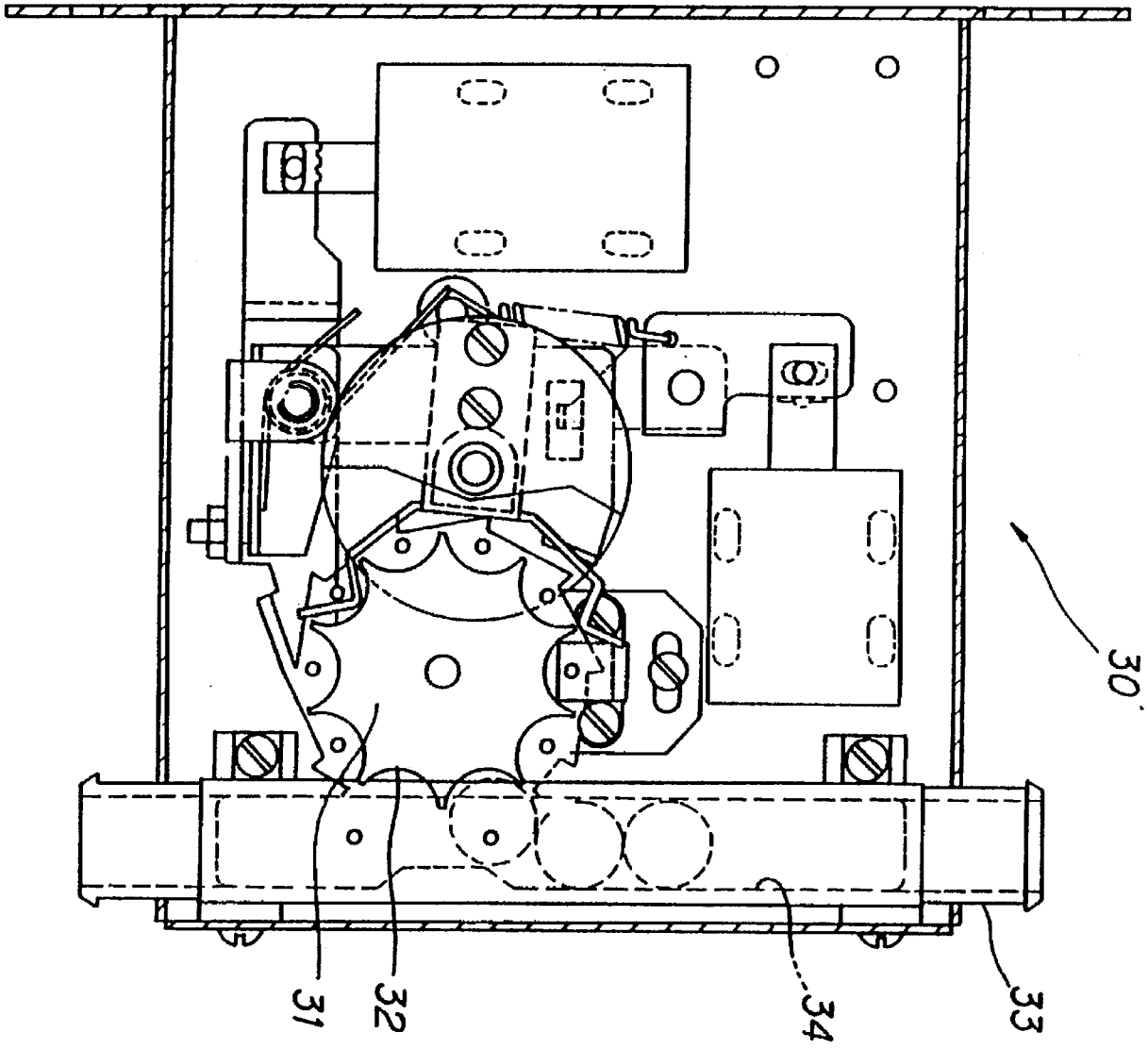
FIG. 6 is a front elevation of the ball counting means of the embodiment of the present invention.

As shown in FIG. 6, the ball counting means 30 is a ball counter which can dispense pachinko balls, correspond to the ordered number, fast and accurately. A sprocket 31, formed with a plural of concave portions 32 in its periphery, is mounted rotatably so as to face concave portions 32 into the interior of a pachinko ball passage 34 formed inside the ball guide means 33 and to catch pachinko balls dropping with gravity one by one by each concave portion 32 with sure rotation of the sprocket 31.

The sprocket 31 is rotated by pachinko balls free dropping by gravity and consecutively for continuous ball dispensing until the number of dispensed balls reach nearly the ordered number of pachinko balls. After the number of dispensed balls has reached the ordered number of the pachinko balls, the consecutive rotation of the sprocket 31 is changed to an intermittent rotation which repeats by little angle rotation, correspond to one movement of the concave portion 32 and stop of rotation. The intermittent rotation of the sprocket 31 is stopped at the moment when the number of dispensed balls has reached the ordered number.

As shown in FIG. 1 and FIG. 2, an overflow path member 60 is connected to an outlet of the ball guide means 33 of the ball counting means 30. The overflow path member 60 is formed integrally in the back side of the game panel 11 and is composed of a supply path 61 for front tray 14 for connecting ball counting means 30 and front tray 14, a supply path 62 for under tray 15, branched from supply path 61 for front tray 14 and connected to under tray 15, that introduces pachinko balls, overflowed from the supply path 61 for front tray 14 to under tray 15 when the front 14 is filled up with pachinko balls, and a supply path 62 for held ball counting means, branched from supply path 61 for under tray and connected to held ball counting means 90, that introduces pachinko balls, overflowed from the supply path 61 for under tray 15 to the held ball counting means 90 when the under tray 15 is filled up with pachinko balls.

In the upper portion of supply path 61 for front tray 14, first opening 63 communicated to the supply path 62 for under tray 15 is formed to flow pachinko balls into the supply path 62, for under tray 14 when the supply path 61 for front tray is overflowed. An outlet 61*a* of the supply path 61 for front tray 14 is directed to a ball dispensing port 14*a*, FIG. 7, and an outlet 62*a* of the supply path 62 for under tray 15 is directed to an overflowed ball dropping port 15*a* of the under tray 15.

Figure 4:
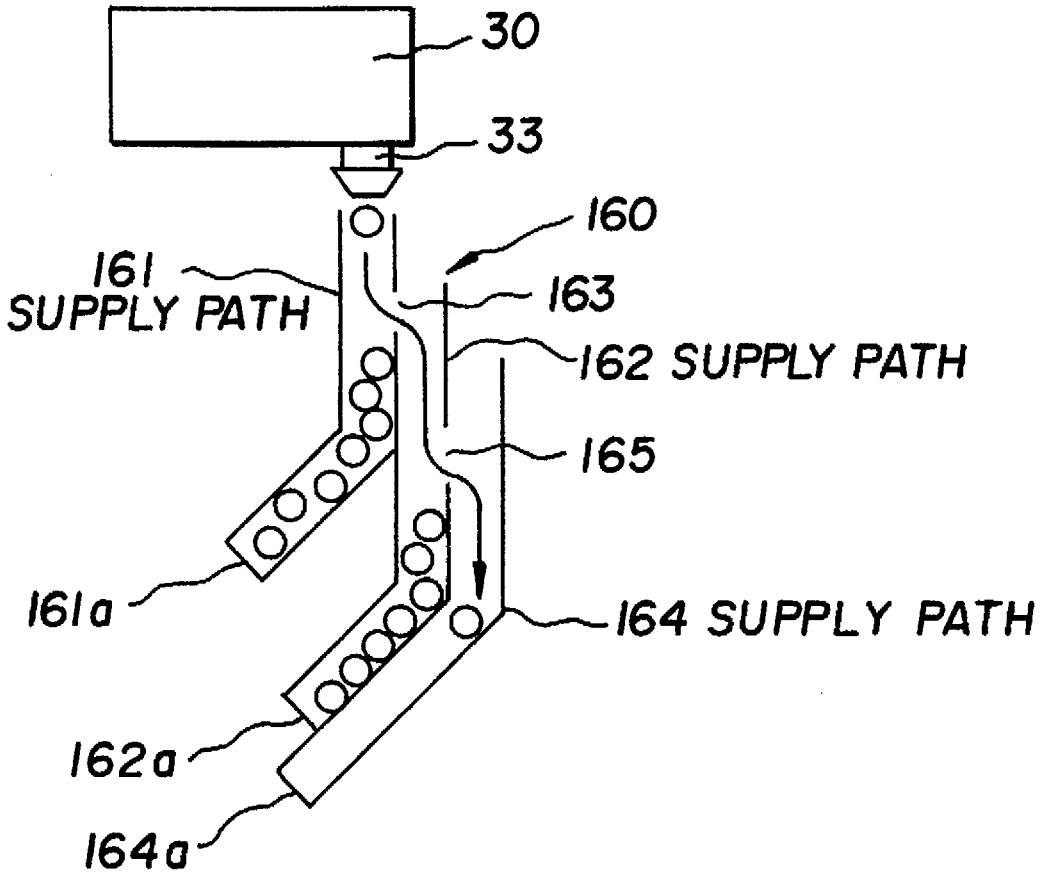
FIG. 4 is a front elevation of the overflow path member of the second embodiment of the pachinko game machine of the present invention.

In the supply path 162, FIG. 4, for under tray 15, second opening 165 communicated to the supply path 164 for held ball counting means is formed to flow pachinko balls into supply path 164 when the supply path 162 for under tray 15 is overflowed. An outlet 164*a* of the supply path 164 is directed to the held ball counting means.

Figure 5:
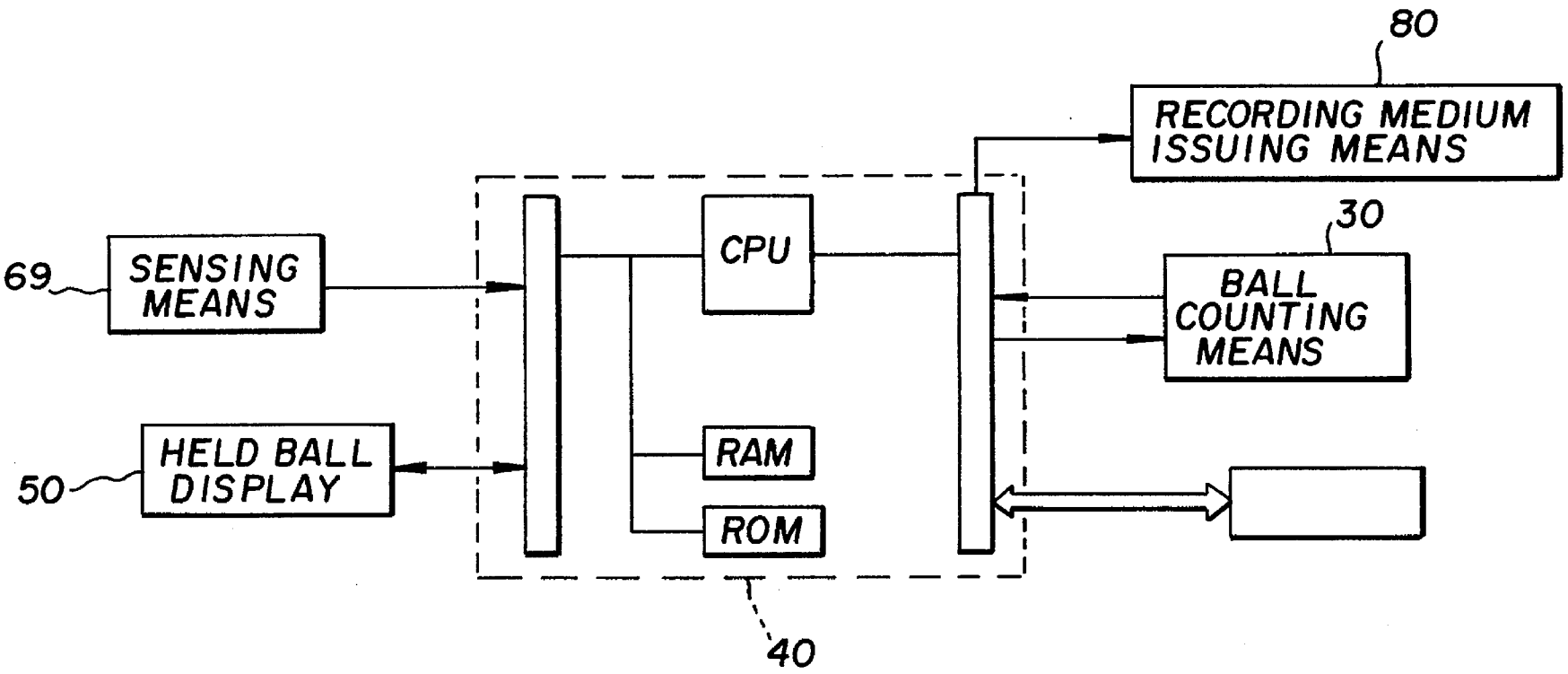
FIG. 5 is a block diagram of the embodiment of the pachinko game machine of the present invention.

As shown in FIG. 5, the control means 40 controls, intensively, the pachinko game machine 10 and ball renting machine 70 and comprises a microcomputer which is composed of an interface, CPU, RAM and ROM. The control means 40 is also connected to a held ball display 50 for outputting a signal thereto when it is received a held ball count signal from the held ball counting means 90.

As shown in FIG. 7, the held ball display 50 is mounted on the front side of the game panel 11 of the pachinko game machine 10. The held ball display 50 displays visibly the number of pachinko balls, according to the orders from said control means 40, and receives signals from the held ball counting means 90 when the counting means 90 counts the pachinko balls introduced from the supply path 64 for held ball counting means. The held ball display 50 is, for example, composed of seven segments LED for displaying the counted number digitally.

As shown in FIG. 1 and FIG. 7, a recording medium issuing means 80 is mounted in the under section of the ball renting machine 70. The recording medium issuing means 80 is connected to the control means 40. When a player operates the ending switch 18 to finish the game, shutters of the front tray 14 and the under tray 15 open to flow pachinko balls remaining in the front tray 14 and the under tray 15 into the held ball counting means 90; then the player's all held balls are displayed in the held ball display 50, and the number of the pachinko balls is recorded in a recording medium, such as a card, by the recording medium issuing means 80 according to the order of the control means 40 and then the recording medium is dispensed from a recording medium getting in and out port 81 to the player.

A ball dropping switch 17 is mounted by the side of the ending switch 18. When under tray 15 or both the under tray 15 and the front tray 14 have capacity for storing more pachinko balls, pachinko balls, corresponding to the number displayed by the held ball display 50, can be dispensed to the under tray 15 or both the under tray 15 and the front tray 14 by operating the ball dropping switch 17.

As shown in FIG. 1 and FIG. 7, a paper money insert slot 71*a* and a coin insert slot 72*a* are mounted on the front side of the ball renting machine 70. The ball renting machine 70 is equipped with a paper money recognizing device 71 and a coin selector 72 that recognize money inserted from the paper money insert slot 71*a* or the coin insert slot 72*a* and output signals correspond to the amount of money to the control means 40.

The control means 40 is connected also to the ball counting means 30. The control means 40 receives signals from the ball renting machine 70 and outputs signals to the ball counting means 30 that order it to dispense given number of pachinko balls correspond to the signals. When a ball falls into prize portion 19 of the game panel 11, the control means 40 sends signals, according to prescribed rates, to the ball counting means 30 for dispensing prize balls.

Another embodiment of the present invention, illustrated in FIGS. 3 and 4, will be explained next.

This embodiment is different from above-mentioned embodiment of FIGS. 1, 2 and 7 only in the overflow path means, so the same components are numbered with the same numerals.

Figure 3:
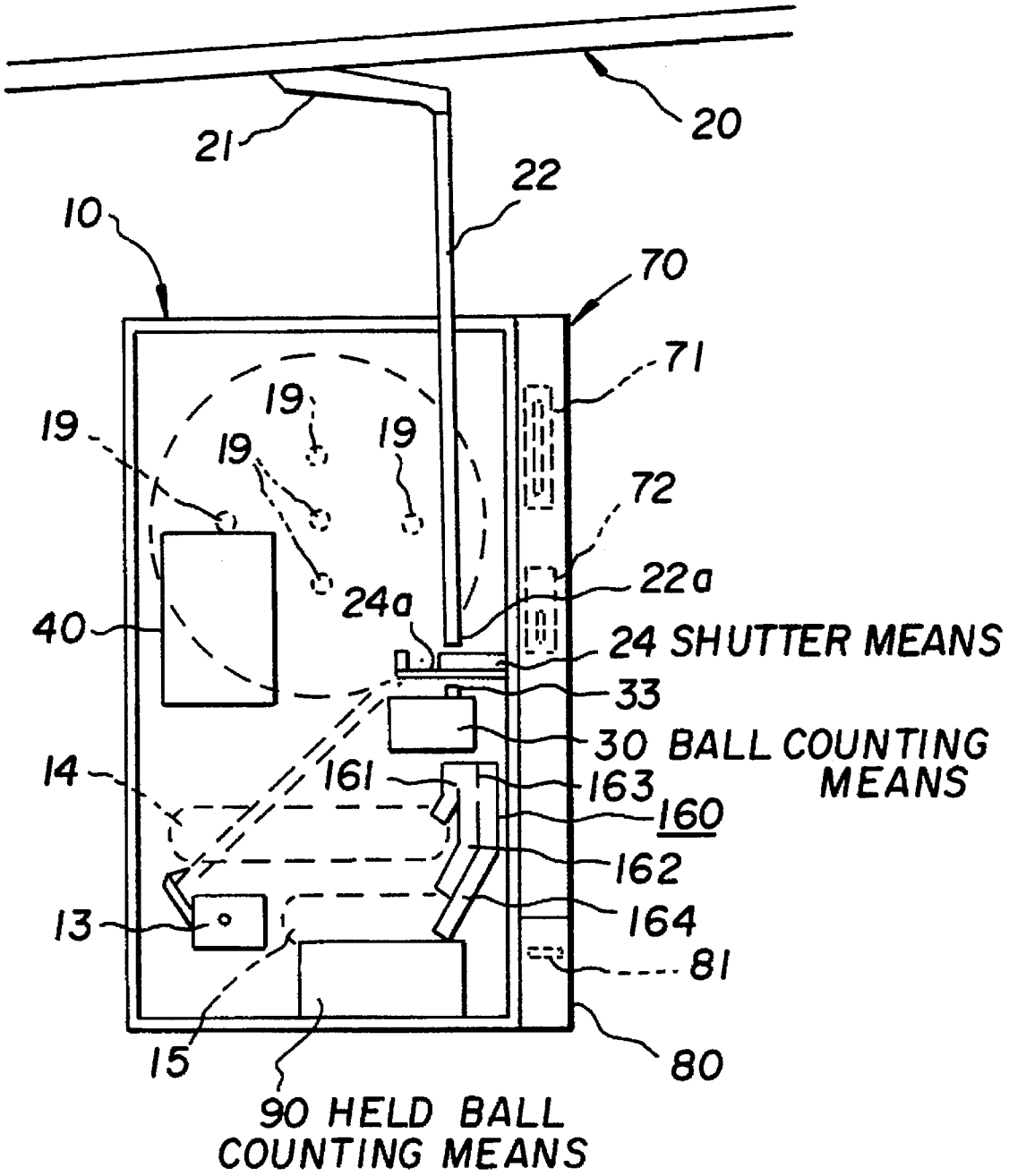
FIG. 3 is a schematic rear elevation of the second embodiment of the present invention.

As shown in FIG. 3 and FIG. 4, an overflow path member 160 is connected to an outlet of the ball guide means 33 of the ball counting means 30. The overflow path member 160 is formed integrally in the back side of the game panel 11. The overflow path member 160 is composed of a supply path 161 for front tray 14 for connecting ball counting means 30 and front tray 14, a supply path 162 for under tray 15, branched from supply path 161 for front tray and connected to under tray 15, that introduces pachinko balls overflowed from the supply path 161 for front tray to the under tray 15 when the front tray 14 is filled up with pachinko balls.

In the upper portion of the supply path 161 for front tray 14, an opening 163, communicated to the supply path 162 for under tray 15, is formed to flow pachinko balls into the supply path 162 for under tray 15 when the supply path 161 for front tray 14 is overflowed. An outlet 161*a* of the supply path 161 for front tray 14 is directed to a ball dispensing port 14*a*, and an outlet 162*a* of the supply path 162 for under tray 15 is directed to an overflowed ball dropping port 15*a* of the under tray 15.

A sensing means 165 is mounted to supply path 162 for under tray 15 and detects the state of the supply path 162 for under tray 15 whether it is jammed with overflowed balls from under tray 15; when the sensing means 165 detects the jammed state of the supply path 162, it outputs a jam signal to a control means 40 for stopping dispensation of pachinko balls by ball counting means 30.

The sensing means 165 is a sensor which is in ON intermittently when pachinko balls flow smoothly within the supply path 162 for under tray 15, but on the other hand it is in ON continuously when the supply path 162 for under tray 15 is jammed with pachinko balls. The sensor outputs overflowing signals to the control means 40 when the ON state continues over 0.5 second.

As shown in FIG. 5, the control means 40 comprises a microcomputer. The microcomputer is composed of an interface connected to a main computer controlling the pachinko game machine 10 and ball renting machine 70 intensively, CPU, RAM and ROM. The control means 40 is connected to the ball counting means 30 to output a stopping signal thereto for stopping the ball counting means 30 when the control means 40 is received an overflowing signal from the sensing means 169.

As shown in FIG. 7, a held ball display 50 is mounted on the front side of the game panel 11 of the pachinko game machine 10. The held ball display 50 displays visibly the number of the remained pachinko balls to be dispensed into the front tray 14 or the under tray 15 by the ball counting means 30 according to the orders from said control means 40 when the dispensing of the ball counting means 30 is stopped.

The held ball display 50 is, for example, composed of seven segments LED for displaying the number of undispensed pachinko balls digitally.

There are two ways for displaying the remaining number of pachinko balls to be dispensed on the held ball display 50 when the under tray 15 is filled up with pachinko balls. One is the way which displays the number of remaining pachinko balls immediately. The other way adds the counted number of the remaining pachinko balls one by one to the displayed number. In the case to dispense 250 pachinko balls by the ball counting means 30, for instance, when the sensing means 165 operates at the moment when 183 balls have been dispensed, remaining 67 balls are displayed on the held ball display 50 in the former. On the other hand, in the latter, if pachinko balls in the front tray 14 etc. are decreased for counting remaining balls and adding the counted number to the displayed number, pachinko balls can flow into the front tray 14 etc.; therefore, the number added to the held ball display 50 is sometimes smaller than 67.

A recording medium issuing means 80, as shown in FIG. 3 and FIG. 7, receives the signal from the control means 40, when a player operates the ending switch 18 to finish the game and records the number of pachinko balls displayed on the held ball display 50 in a recording medium, such as a card etc. and then dispenses it from a recording medium through in and out port 81 to the player.

The summary of the operation of the embodiment will be explained next.

As shown in FIG. 1, pachinko balls, flowing in the supply conduit 20 located in the game machine island, are sent to the pachinko game machine 10 through the communicating members, the chute member 21 and bellows member 22, and supplied to the ball counting means 30 mounted in the pachinko game machine. At this time the shutter means 24 is opened. Since pachinko balls in the supply conduit 20 are directly supplied to the ball counting means 30, mounted in the pachinko game machine through the chute member 21 and bellows member 22, a storage means positioned in the upper section of the pachinko game machine, such as an upper tray etc., for storing pachinko balls temporarily is not required.

From the pachinko balls supplied to the ball counting means 30, a given number of counted pachinko balls are dispensed into the front tray 14 or the under tray 15, based on the signal from a control means 40 for controlling the pachinko game machine. Firstly, pachinko balls, to explain in detail, released from the ball counting means 30, flow through a ball dispensing port 14*a*, FIG. 7, into the front tray 14 via the supply path 61 for front tray of the overflow path member 60. When the front tray 14 has been filled up with the pachinko balls, the balls overflowed from the supply path 61 for front tray 14 are introduced into the supply path 62 for under tray 15 via the first opening 63 formed in the supply path 61, and they pass through the supply path 62 into the under tray 15 via the overflowed ball dropping port 15*a*.

When also the under tray 15 has filled up with the pachinko balls in the embodiment of FIGS. 3 and 4, the balls overflowed from the supply path 162 for under tray 15 introduced into the supply path 164 for held ball counting means via the second opening 165 formed in the supply path 162, and they pass through the supply path 164 into the held ball counting means 90. The over flowed balls that have introduced into the held ball counting means 90, FIG. 3, are counted therein and discharged into a conduit for collecting.

After counting the balls, as shown in FIG. 5, the held ball counting means 90 outputs counted ball signals, which indicate the counted number, to the control means 40. Then the counted number of the pachinko balls are displayed visibly by the held ball display 50, FIG. 7, according to the orders from the control means 40 which has received signals from the held ball counting means 90.

Therefore, there is no need for the game machine to interrupt a game in play to prevent pachinko balls from overflowing from the under tray 15.

When rental balls and prize balls, dispensed from the ball counting means 30, are excessive over the capacity of the front tray 14 and the under tray 15 and overflow from the under tray 15, the overflowed balls are introduced into the held ball counting means 90 and are counted therein. The counted number is displayed on the held ball display 50 and a player can continue to play the game without interruption.

When under tray 15 or both the under tray 15 and the front tray 14 have capacity for storing more pachinko balls by using pachinko balls in the front tray 14 in the game, remained pachinko balls, corresponding to the number displayed by the held ball display 50, can be dispensed to the under tray 15 or both the under tray 15 and the front tray 14 through the ball counting means 30 by operating the ball dropping switch 17.

When a player operates the ending switch 18 to finish the game, shutters of the front tray 14 and the under tray 15 open to flow pachinko balls remaining in the front tray 14 and the under tray 15 into the held ball counting means 90; then all the player's held balls are displayed in the held ball display 50 and the held ball counting means 90 sends signals to the control means 40, and the data, such as the number of the pachinko balls, are sent to the recording medium issuing means 80 for recording the data in a recording medium, such as a card, etc. by the recording medium issuing means 80, according to the order of the control means 40, and then the recording medium is dispensed to the player from the out port 81. The player can replace the pachinko balls with articles at the replacing counter. Therefore, it is unnecessary for a player to carry pachinko balls.

If the pachinko game machine 10 is broken, a front door including the game panel 11 of the pachinko game machine 10 need to be opened. But the ball counting means 30 is in operation, pachinko balls are dropped by opening the front door. Therefore, in the pachinko game machine 10 of the present embodiment, when the front door is opened, a lever 24*a*, of the shutter means 24, cooperates with the door, in closing the shutter means 24 automatically, and stops flowing of pachinko balls.

The summary of the operation of the second embodiment will be explained next.

As in the first embodiment, from the pachinko balls supplied to the ball counting means 30, a given number of pachinko balls are dispensed into the front tray 14 or the under tray 15, and are counted, based on the signal from a control means 40 for controlling the pachinko game machine. Firstly, pachinko balls, to explain in detail, released from the ball counting means 30 flow through a ball dispensing port 14*a*, FIG. 7, into the front tray 14 via the supply path 161 for front tray of the overflow path member 160. When the front tray 14 has been filled up with the pachinko balls, the balls overflowed from the supply path 161 for front tray introduced into the supply path 162 for under tray 15 via the opening 163 formed in the supply path 161, and they pass through the supply path 162 into the under tray 15 via the overflowed ball dropping port 15*a*.

When the under tray 15 has been filled up with pachinko balls, the supply path 162 for under tray 15 is jammed with pachinko balls overflowed from the under tray 15. The jammed state of the supply path 162 is detected by the sensing means 69. If the jammed state of the supply path 162 causes the continuous ON state of the sensing means 69 over 0.5 second, overflow signals are sent to the control means 40. When the control means 40 received the overflow signals, it outputs stopping signals to the ball counting means 30 for stopping dispensation of the pachinko balls immediately.

When the dispensation of the ball counting means 30 is stopped by the overflow of the under tray 15, the number of the remained pachinko balls to be dispensed is visibly displayed in digital according to the orders from said control means 40. Therefore, it is no need for the game machine to interrupt a game being played in order to prevent pachinko balls from overflowing from the under tray 15.

The game can be continued with displaying the number of held balls in the held ball display 50 and without actual dispensing of the balls, for example prize bails, into the front tray 14 etc. There are two ways for displaying the remaining number of pachinko balls to be displayed on the held ball display 50. One is the way which displays the number of remaining pachinko bails immediately. The other adds the counted number of the remaining pachinko bails, one by one, to the displayed number.

When under tray 15 or the front tray 14 have capacity for storing more pachinko balls by using pachinko balls in the front tray 14 in the game, remained pachinko bails corresponding to the number displayed by the held ball display 50, can be dispensed to the under tray 15 or the front tray 14 through the ball counting means 30 by operating the ball dropping switch 17, FIG. 7.

In the case that the pachinko game machine 10 has not a recording medium issuing means 80, if an ending switch 18 is operated, pachinko balls, of the number displayed in the held ball display 50, are dispensed into the front tray 14 or under tray 15, by ball counting means 30, until he displayed number decreased to zero. A player can replace the pachinko balls dispensed into the front tray 14 or the under tray 15 with articles.

In the case that the pachinko game machine 10 has recording medium issuing means 80, when a player operates the ending switch to finish the game, shutters of the front tray 14 and the under tray 15 open to flow pachinko balls remaining in the front tray 14 and the under tray 15 into the held ball counting means 90; then the player's all held balls are displayed in the held ball display 50, and the number of the pachinko balls is recorded in a recording medium, such as a card etc. by the recording medium issuing means 80 according to the order of the control means 40 and then the recording medium is dispensed to a player from the out port 81. The player can replace the pachinko balls with articles at the replacing counter. Therefore it is unnecessary for a player to carry pachinko balls.

If the pachinko game machine 10 is broken, a front door, including the game panel 11 of the pachinko game machine 10, need to be opened. But the ball counting means 30 is in operation, pachinko balls are dropped by opening the front door. Therefore, in the pachinko game machine 10 of the present embodiment, when the front door is opened, a lever 24*a* of the shutter means 24 cooperates with the door in closing the shutter means 24, automatically, and stops flowing of pachinko balls.

INDUSTRIAL APPLICABILITY

According to the pachinko game machine of the present invention, since pachinko balls are directly sent to the ball counting means from the supply conduit through the communicating member, they are supplied efficiently. The pachinko balls dispensed from the ball counting means are introduced into the front tray via the supply path for front tray of the overflow path member. When the front tray has been filled up with the pachinko balls, the balls are introduced into the under tray via the supply path for the under tray, and then the balls overflowed from the under tray are introduced into the held ball counting means for counting and the counted number of the balls are displayed by the held ball display. When the under tray is filled up with the balls, it is detected by the sensing means and the dispensing of the ball counting means is stopped by the control means; then the number of the remained balls to be dispensed is displayed by the held ball display. Therefore, there is no need for the pachinko game machine to be interrupted during a game for preventing pachinko balls from overflowing from the under tray, and a player can continue to enjoy game without spoiling his interest.

We claim:

1. A pachinko game machine having a ball counting means for dispensing a given number of pachinko balls based on the signal from a control means for controlling the pachinko game machine being supplied pachinko balls from a supply conduit to the control means through communicating members located in a game machine island, the pachinko game machine comprising:

a front tray for storing pachinko balls dispensed by a player to said ball counting means;

an under tray for storing overflowed balls from said front tray;

a held ball counting means, mounting under said under tray, for counting pachinko balls overflowed from the under tray;

an overflow path member for introducing pachinko balls dispensed from said ball counting means to said front tray, said under tray and said held ball counting means in a back side of a game panel of said pachinko game machine, said overflow path member being composed of:

a supply path for said front tray for connecting said ball counting means and said front tray, a supply path for said under tray, branched from said supply path for said front tray and connected to said under tray, for introducing pachinko balls overflowed from said supply path for said front tray to said under tray when said front tray is filled up with pachinko balls, and a supply path for a held ball counting means, branched from said supply path for said under tray and connected to said held ball counting means, for introducing pachinko balls overflowed from said supply path for said under tray to said held ball counting means when said under tray is filled up with pachinko balls; and a held ball display, mounted on a front side of said game panel, for displaying visibly the number of said pachinko balls according to the orders from said control means which receives signals from said held ball counting means when said counting means counts the pachinko balls introduced from said supply path to said held ball counting means.

2. A pachinko game machine as in claim 1, further comprising a recording medium issuing means for recording the number of pachinko balls displayed by said held ball display on a recording medium and dispensing said recording medium to a player after a game has been completed.

3. A pachinko game machine as in claim 1 or 2, further comprising a ball dropping switch for dispensing pachinko balls in the number displayed by said held ball display into said under tray or both said under tray and said front tray through said control means when said under tray or both said under tray and said front tray have capacity for storing more pachinko balls.

4. A pachinko game machine having a ball counting means for dispensing a given number of pachinko balls, based on a signal from said control means for controlling the pachinko game machine and being supplied pachinko balls from a supply conduit to a control means through communicating members located in a game machine island, the pachinko game machine comprising:

a front tray for storing pachinko balls dispensed to a player by said ball counting means;

an under tray for storing overflowed balls from said front tray;

an overflow path member for introducing pachinko balls dispensed from said ball counting means to said front tray and the under tray in the back side of a game panel of said game machine, said overflow path member being composed of:

a supply path for said front tray for connecting said ball counting means and said front tray, and a supply path said under tray, branched from said supply path for said front tray and connected to said under tray, for introducing pachinko balls overflowed from a supply path to said front tray to said under tray when said front tray is filled up with pachinko balls;

a sensing means, mounted to said supply path to said under tray, for detecting the state of said supply path for under tray being jammed with overflowed balls from said under tray and outputs a jam signal to said control means for stopping dispensation of pachinko balls by said ball counting means; and a held ball display, mounted on a front side of said game panel, which displays visibly the number of remaining pachinko balls to be dispensed when pachinko balls overflow from said under tray and said ball counting means interrupt the dispensation of pachinko balls.

5. A pachinko game machine as in claim 4, further comprising a recording medium issuing means for recording the number of pachinko balls displayed by said held ball display on a recording medium and dispensing said recording medium to a player after a game is completed.

6. A pachinko game machine as in claim 4 or 5, further comprising a ball dropping switch for ordering the dispensation of pachinko balls of the number displayed by said held ball display into said under tray or both said under tray and said front tray through said control means when said under tray or both said front tray and said front tray have capacity for storing more pachinko balls.

* * * * *